US006860278B2

(12) United States Patent
Huang

(10) Patent No.: US 6,860,278 B2
(45) Date of Patent: Mar. 1, 2005

(54) CLEAN-UP EQUIPMENT OF THE SPRAYING PAINT GUN

(75) Inventor: Iung-Jie Huang, Taipei Hsien (TW)

(73) Assignee: Chia Chung Enterprise Co., Ltd., Taipei Hsien (TW)

( * ) Notice: Subject to any disclaimer, the term of this patent is extended or adjusted under 35 U.S.C. 154(b) by 439 days.

(21) Appl. No.: 10/098,408

(22) Filed: Mar. 18, 2002

(65) Prior Publication Data

US 2003/0172964 A1 Sep. 18, 2003

(51) Int. Cl.[7] ..... B08B 3/02

(52) U.S. Cl. ..... 134/170; 134/166 C; 134/199; 134/200

(58) Field of Search ..... 134/167 R, 168 R, 134/169 R, 169 A, 170–172, 198–200, 168 C, 167 C, 169 C, 166 C; 118/300, 302; 211/106.01

(56) References Cited

U.S. PATENT DOCUMENTS 2,682,273 A * 6/1954 Roach ..... 134/102.1
2,786,000 A * 3/1957 Roach ..... 134/21
3,771,539 A * 11/1973 De Santis ..... 134/111
4,025,363 A * 5/1977 De Santis ..... 134/102.2
4,785,836 A * 11/1988 Yamamoto ..... 134/56 R
4,793,369 A * 12/1988 Robb et al. ..... 134/170
4,827,955 A * 5/1989 Stern ..... 134/99.1
4,899,769 A * 2/1990 Tsai ..... 134/111
4,923,522 A * 5/1990 Sowers ..... 134/22.1
4,960,142 A * 10/1990 Robb et al. ..... 134/166 C
5,174,317 A * 12/1992 Robb et al. ..... 134/138
5,193,561 A * 3/1993 Robb et al. ..... 134/57 R
5,213,117 A * 5/1993 Yamamoto ..... 134/58 R
5,220,933 A * 6/1993 Albers ..... 134/58 R
5,388,601 A * 2/1995 Mansur ..... 134/56 R
5,485,860 A * 1/1996 Robb et al. ..... 134/166 C
5,937,875 A * 8/1999 Nygren ..... 134/22.11
6,003,530 A * 12/1999 Giuseppe ..... 134/102.1
2002/0074024 A1 * 6/2002 Schwartz ..... 134/34

FOREIGN PATENT DOCUMENTS

JP 63297906 A * 12/1988 ..... F23D/11/38

* cited by examiner

*Primary Examiner*—Frankie L. Stinson
*Assistant Examiner*—Joseph L Perrin
(74) *Attorney, Agent, or Firm*—Rosenberg, Klein & Lee

(57) ABSTRACT

A cleaning equipment for a spraying paint gun includes a container, a branch sum up, a pipeline structure, an auxiliary rock set, a coth-hook set, and a buckle structure. The pipeline structure is settled inside the container whereas the auxiliary rock set is fixed and settled on the pipeline structure. The cloth-hook set is settled on the branch sum up of the fixed container whereas the buckle structure is used to fix the brake shaft and the handle of the spraying paint gun so that inside the pipeline of the spraying paint gun it is open.

7 Claims, 4 Drawing Sheets

CLEAN-UP EQUIPMENT OF THE SPRAYING PAINT GUN

BACKGROUND OF THE INVENTION

1. Field of the Invention

This invention relates to a clean-up equipment of the spraying paint gun, especially relates to a technology of paint solution which could completely clean the inner pipeline of the spraying paint gun after injecting the cleaning-up solvent into the pipeline structure by means of the assembly layout vertically or inclination standing on the pipeline structure of the direct-flowing typed spraying vent or the froze spraying vent.

2. Description of the Prior Art

In order to make the surface color of the objects uniform and beautiful, paint spraying is generally used, wherein the principle of spraying paint utilizes compressed air to thin the paint liquid injected inside the inner pipeline of the spraying paint gun. Next, it ejects the paint from the ejection vent of the spraying paint gun so that it uniformly covers the thinner paint liquid onto the object. However, after using a spraying paint gun there is sometimes a lot of paint liquid residing in the inner pipeline of the spraying paint gun. Incomplete cleaning will cause the paint residue in the spraying paint gun to corrode the inner pipeline of the spraying paint gun, which severely influences the useful life of the spraying paint gun.

The traditional way of cleaning up the spraying paint gun is shown in the FIGS. 1(A) and 1(B) which are both processed inside a container with pipeline structure. FIG. 1(A) shows the clean-up condition of a gravitational spraying paint gun. The way how the gravitational typed spraying paint gun is being cleaning up is first to disassemble the paint can and to proceed cleaning on the ejecting vent hanged below the pipeline structure; before this step, the braking hand of the spraying paint gun is pressed and pulled with the buckle means; besides, on the outside of the paint can and outside the spraying paint gun, the cleaning solvent is injected by the nozzle typed injection head settled on two lateral sides of the pipeline structure; the major drawback of this kind of cleaning is when proceeds cleaning the paint can, the cleaning solvent is easily to eject from the inlet of paint on the paint can which reduces the performance of cleaning solvent so that there requires more cleaning solvent to compromise the insufficiency of the cleaning solvent required by the paint can, which makes the effect of cleaning losing its effect; and due to the limitation of the angle of the gravitational typed spraying paint gun, so on cleaning with fixed typed, it will cause face upward of the gun of the spraying paint which makes the cleaning solvent back-flowing into the edge of the spraying gun due to the influence of the gravity during the process of clean-up the spraying paint gun; during this clean-up status, it will even make the smaller slim inside the gun or other positions untouch the paint polluted which is easily badly influenced for the processing of next spraying paint task; besides, the upper cap of the paint can could not being proceeded cleaning-up inside the container on the same time; FIG. 1(B) is the cleaning condition of the absorb-upward typed spraying paint gun; when it proceeds cleaning using the same container, the paint can is also relieved and hanged above the direct-flowing typed spraying vent below the pipeline structure, whereas after the braking handle of the spraying paint gun is being buckled with the buckle means, the inlet tube of the paint material is covered with the injection vent below the pipeline structure to proceed cleaning; besides, on the outside of the paint can and the spraying paint gun, the cleaning solvent is ejected from the spraying typed ejection vent settled on two lateral sides of the pipeline structure; the main drawback of this kind of cleaning is that it is not easily to be cleaned inside the paint can so the cleaning up could only be proceeded through the cleaning solvent flowing by gravity which way of cleaning could hardly clean the inside surface of the paint can.

Besides, since there is quite difference between the disassembly structure of the gravitational typed spraying paint gun and the absorb upwardly typed spraying paint gun, when they are cleaned, there is height difference between two kinds of the spraying paint gun, so it is not allowed to use the same direct-flowing spraying vent (because the spraying paint gun is required to be cleaned within a specific height range which will reduce the dead angle of cleaning and achieve the cleaning maximum), when proceeds cleaning different kinds of spraying paint gun, the gun should be disassembled and changed into the direct-flowing spraying vent with various height to achieve the required cleaning effect.

From this we know that there still is design insufficiency for the above-mentioned traditional object which is not a perfect design and is in need of improvement urgently.

The inventor of this invention, due to each drawback derived from the above-mentioned traditional spraying paint gun cleaning equipment, thinks to improve it and innovate it and studies for many years and finally he succeeds in completing this cleaning equipment of the spraying paint gun of this invention.

SUMMARY OF THE INVENTION

The purpose of this invention is to provide a cleaning equipment of the spraying paint gun which, by means of the assembly layout of the direct-flowing ejection vent and the frozy spraying vent to be vertically or with inclination standing on the pipeline structure and to eject the cleaning solvent into the pipeline structure it could fully clean the paint solution on the inner pipeline of the spraying paint gun.

Another purpose of this invention is to provide a cleaning equipment of the spraying paint gun which, by means of the horizontal bar coupling, single-cross coupling and double-cross coupling contained by the coupling set provided by said equipment which could hang each structure of the spraying paint gun on said coupling set after being cleaning up.

Another purpose of this invention is to provide a cleaning equipment of the spraying paint gun which, by means of the stopping frame and a settling frame provided, when the graviton typed spraying paint is being cleaned, the stopping frame could aid in the graviton typed spraying paint gun to positioning, and when the absorb upward typed spraying paint gun is being cleaned, the settling frame could aid in the paint coverage container cap of the absorb upward typed spraying paint to positioning.

Another purpose of this invention is to provide a cleaning equipment of the spraying paint gun which, by means of the outside of the container settled the auxiliary cleaning container inside which there contains the cleaning solvent which could do the pre-wash motion before the spraying paint gun is being cleaned.

Another purpose of this invention is to provide a cleaning equipment of the spraying paint gun which could provide the direct-flowing spraying vent of the pipeline structure which takes concerted action with a spinning cap and the cap could be locked to stop the action of the direct-flowing spraying flowing vent.

Another purpose of this invention is to provide a cleaning equipment of the spraying paint gun, i.e., a buckle means is provided; by means of said buckle means to fix the graviton typed and absorb upward braking shaft and handle spraying paint gun so that the inner pipeline of the spraying paint gun is open and when cleaning the cleaning solvent is flowing.

Another purpose of this invention is to provide a cleaning equipment of the spraying paint gun which is the container that could insert the pipeline structure and the cross-sectional geometry shape on the bottom of said container is smaller than the cross-sectional geometry shape on top of the container so that the cleaning solvent is easily to be collected and drain from the vent on the bottom of the container.

Another purpose of this invention is to provide a cleaning equipment of the spraying paint gun that could achieve the above-mentioned purpose of the invention at least comprises:

A container, on top of said container is a vent, there cooperates with said vent is an upper cap, and on the bottom of the container there besides settles one injection vent and one drain vent, and the cross-sectional geometry shape on the bottom of said container is smaller than the cross-sectional geometry shape on the top of the container; besides, on the outside of said container there settles one auxiliary cleaning container;

A branch sum up which is used to install and support the container;

A pipeline structure which is installed inside the container, said pipeline structure is a pipeline channel connecting and settling one input pipe, at least a direct-flowing ejection vent and at least one frozy spraying vent wherein said input pipe is connecting with the injection vent of the container, said direct-flowing spraying vent is cooperative with one spinning cap, which could lock and cover the spraying vent of direct flowing whereas at least one direct-flowing spraying vent and frozy spraying vent is settled within the way of tiled on the channel of the pipeline whereas others are settled with the way of vertically with the pipeline;

An auxiliary rock set, said auxiliary rock set is composed of the rigid wiring material and is locked and fixed on the proper place of the pipeline whereas said auxiliary rock set at least comprises a stopping rock and a plating rock;

A cloth-hook set which is connected on the branch sum up whereas said cloth-hook set at least comprises a cross-bar cloth-hook, a single-cross cloth-hook and a double-cross cloth-hook;

A buckle means which is composed of the rigid wiring body whereas said buckle means is interconnecting with the pipeline structure with a wiring body.

BRIEF DESCRIPTION OF THE DRAWINGS

The drawings discloses an illustrative embodiment of the present invention which serves to exemplify the various advantages and objects hereof, and are as follows.

DETAILED DESCRIPTION OF THE PREFERRED EMBODIMENT

Figure 1A:
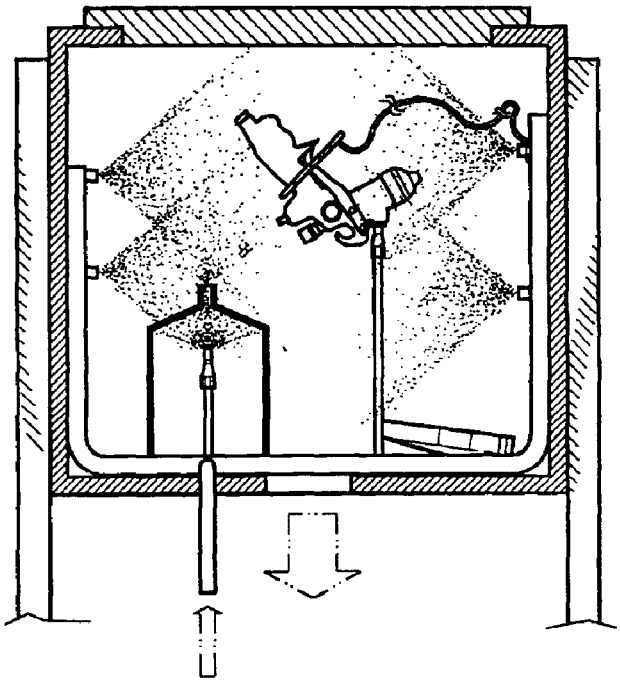
PRIOR ART FIG.1(A)
FIGS. 1(A) and 1(B) are the schematic figure of the cleaning equipment application of the traditional spraying paint gun.
Figure 1B:
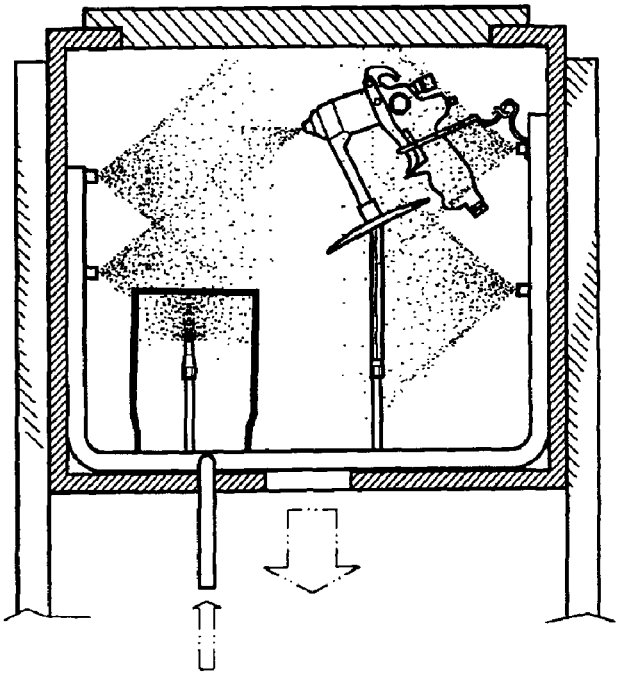
PRIOR ART FIG.1(B)
Figure 2:
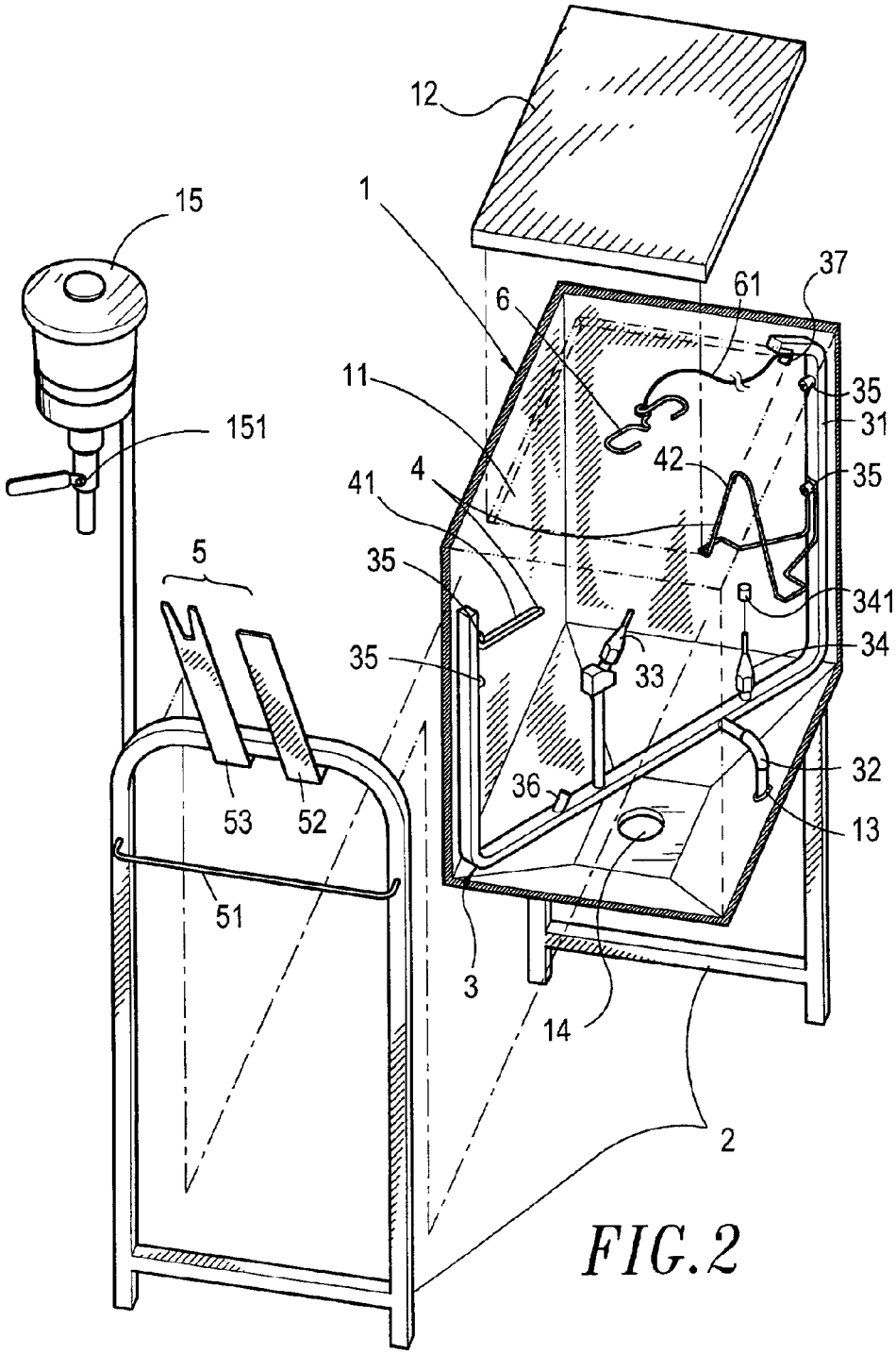
FIG. 2 is the solid vision figure of the cleaning equipment of the spraying paint gun of this invention.

Please refer to FIG. 2, the cleaning equipment of the spraying paint gun provided by this invention is comprised mainly of a container 1, a branch sum up 2, a pipeline structure 3, an auxiliary rock set 4, a cloth-hook set 5 and a buckle means 6; the top portion of said container 1 is a vent 11 which is in cooperation with an upper cap 12, on the bottom of the container 1 there besides settles an injection vent 13 and a drain vent 14 separately whereas the cross-sectional geometry shape of the bottom of said container 1 is smaller than that of the top portion of the container; besides, outside said container 1 there settles an auxiliary cleaning container 15 separately wherein said branch sum up 2 is used to install and support the container 1; said pipeline structure 3 is settled inside the container 1; said pipeline structure is comprised of a pipeline channel 31 in connection with an input tube, the direct-flowing spraying vent 33 and 34 and the frozy spraying vent 35, 36, 37; said direct-flowing spraying vent could be in cooperation with a spraying cap 341; whereas said input tube 32 is in connection with the inlet vent 13 of the container 1; one thing has to be explained in addition is: said directflowing spraying vent 33 and the frozy spraying vent 36, 37 are settled with the way of match-cross in inclination with the pipeline channel 31, direction of the direct-flowing spraying vent 34 and other frozy spraying vent are settled in vertical with the pipeline channel 31; said auxiliary rock set 4 comprises a stopping rock 41 and a place rock 42 which are both coiled of rigid wire material; and on the proper position locked and fixed on the pipeline structure said cloth-hook set 5 is connecting on the pipeline structure said cloth-hook set 5 is connecting on the branch sum up 2, and said cloth-hook set 5 further comprises a cross-bar cloth-hook 51, a single-cross cloth-hook 52 and a double-cross cloth-hook 53; said buckle means 6 is comprised of winging the rigid wire material and it is further interconnected with the pipeline structure 3 with a wiring body 61.

Figure 3A:
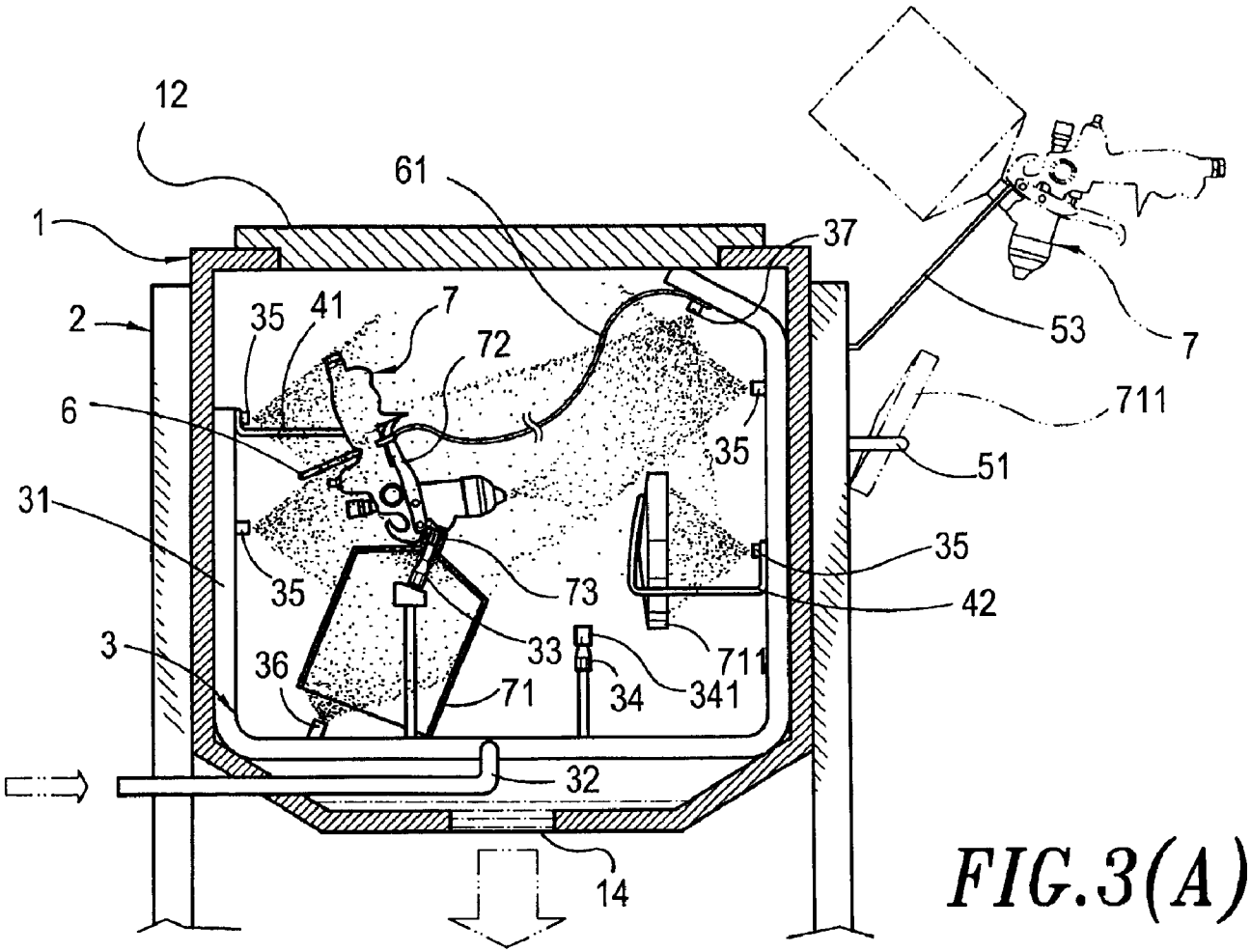
FIG. 3(A) is the first embodiment vision figure of the cleaning equipment of said spraying paint gun.

Please refer to FIG. 3(A), which is the condition of proceeding cleaning within the container 1 of the graviton typed spraying paint gun 7; the cleaning way of the graviton typed spraying paint gun 7; the cleaning way of the graviton typed spraying gun 7 on the direct-flowing typed spraying vent 33 below the pipeline structure 3; meanwhile, the stopping rock 41 settled above the pipeline structure 3 could aid in the graviton typed spraying paint gun 7 to positioning, before proceeding this step, the brake handle 72 of the graviton typed spraying paint gun 7 is fasten with the buckle means 6 whereas the cleaning solvent is flowing into the input tube 32 from the injection tube 32 from the injection vent 13 of the container 1, and the cleaning solvent is guided into the direct-flowing typed spraying vent 33 of the pipeline structure 3 from the input tube 32 and each frozy spraying vent 35, 36, 37; meanwhile, spraying vent 33 is spraying and the spraying vent 34 is capped with a spraying cap 341, during proceeding of the cleaning, the cleaning solvent could be injected into the inner paint channel of the graviton typed spraying paint gun 7 by the direct-flowing typed spraying typed spraying vent and achieves the purpose of cleaning; at this time, the frozy spraying vent 36 could eject the cleaning solvent into the internal of the paint can 71 to proceed spraying and cleaning whereas outside the paint can 71 and the graviton typed spraying paint gun 7 the solvent is ejected from the frozy spraying vent 37 settled on two vertical laterals of the pipeline structure 3 and the frozy spraying vent 37 cross-settled to proceed cleaning; the upper cap 711 of the paint can 71 is settled above the place rack 42; besides, by means of the frozy spraying vent 35 it proceeds spraying and washing motion; because the cross-sectional geometry shape of the bottom of the container 1 is smaller than that of the top of the container which is a cone shaped design and could gather and collect the cleaning solvent inside the container 1 and is drain out from the drain vent; after finish the cleaning, the graviton typed spraying paint gun 7 could be inserted and hanged on the double-cross cloth-hook 53 to dry-out according to the embedded design on the neighboring portion of the inlet of the paint material 73 of the paint can 71 whereas the upper can 711 could be put on the cross-bar cloth-hook to dry out.

Figure 3B:
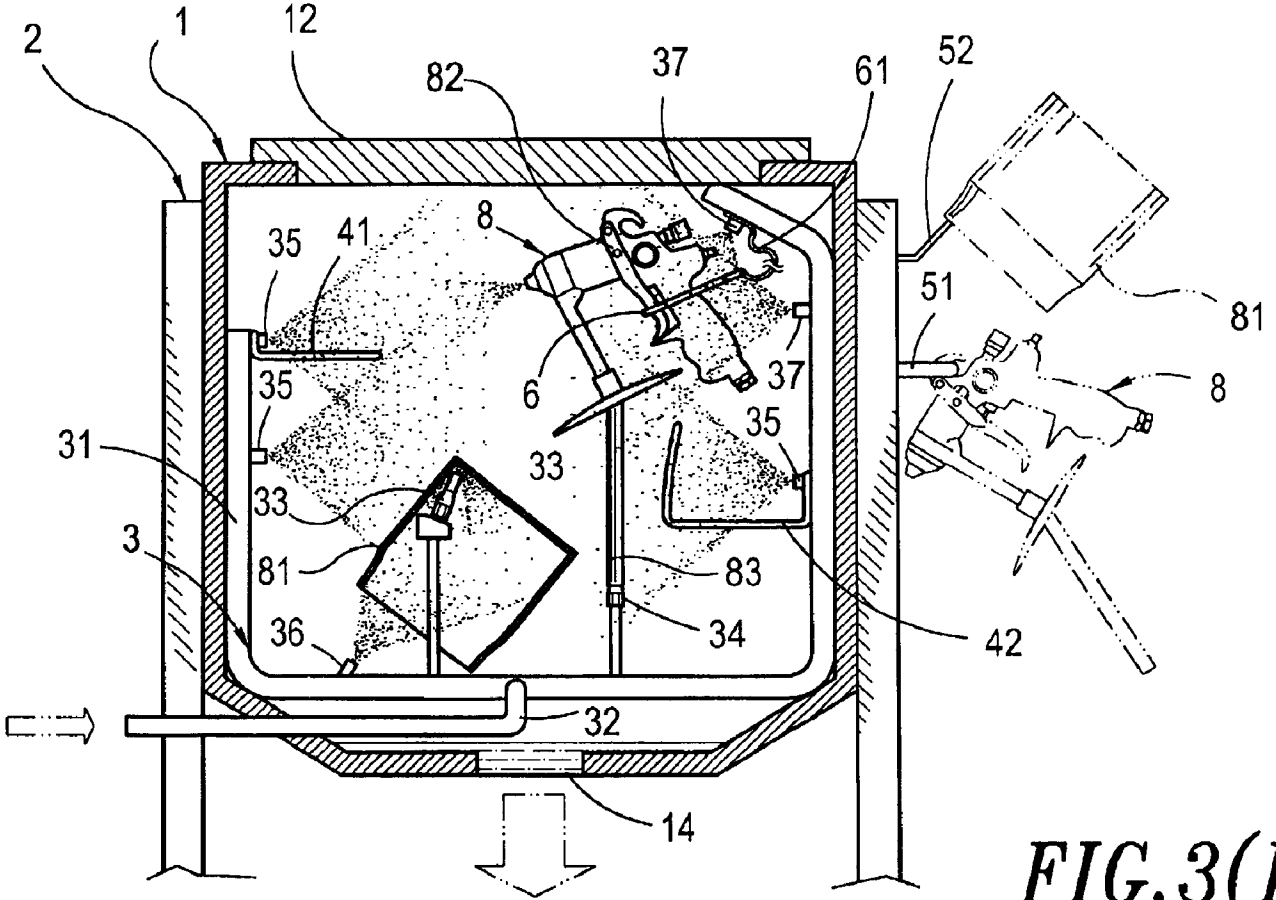
FIG. 3(B) is the second embodiment vision figure of the cleaning equipment of said spraying paint gun.

Please refer to FIG. 3(B), which is the cleaning condition of the absorb-upward typed spraying paint gun, when the same container 1 equipment is being used to proceed the spraying and cleaning of the absorb-upward typed spraying paint gun 8, it is necessary to disassembly the paint can 81 and sleeve-and-hang on the direct-flowing typed spraying vent 33 below the pipeline structure 3 whereas the brake handle 72 of the absorb-upward typed spraying paint gun 8 is fasten with the buckling means 6 beforehand; the cleaning solvent is flowing into the input tube 32 from the injection vent 13 of the container 1 and is guided into the direct-flowing typed spraying vent 33 and 34 and each frozy spraying vent 35, 36, 37 of the pipeline structure 3 by the inlet tube 32; on proceeding clean-up, the cleaning solvent could be ejected inside the paint can 81 by the direct-flowing typed spraying vent 33 whereas the solvent could be ejected into the inner channel of the absorb upward typed spraying paint gun 8 by the spraying vent 34 to achieve the purpose of cleaning; meanwhile, the cleaning solvent could be ejected inside the paint can 81 to proceed spraying and cleaning on the same time by the frozy spraing vent 36, on outside of the paint can 81 and the absorb-upward typed spraying paint gun 8 the solvent is ejected by the frozy spraying vent 35, 36 settled on two lateral sides of the pipeline structure 3 and the cross-settled frozy spraying vent 37 to proceed cleaning; the same condition as above-mentioned, since the cross-sectional equipment of the spraying paint gun provided by this invention has advantages in comparison with the above-mentioned traditional technologies as outlined below.

Since the cross-sectional geometry shape of the bottom of the container 1 is smaller than that of the top of the container which is the same shaped design, it is fair to collect the cleaning solvent inside the container 1 and drain out from the drain vent 14; after finish cleaning, the absorb-upward typed spraying paint gun 8 could be hooked and hanged on the cross-bar cloth-hook to dry out whereas the paint can 81 could be hooked and hanged on the single-cross cloth-hook 52 to dry out.

Next, inside the auxiliary cleaning container 15 settled by outside the container 1 there places the cleaning solvent; by the design of the gate valve switch 151 below the auxiliary cleaning container 15 it could decide if the cleaning solvent is allowed to flowing out and it could inject the cleaning solvent into the paint can 71 or 81 or other portion stick to large paint solution before cleaning the spraying paint gun to proceed the motion of initial pre-washing so that the subsequent cleaning motion inside the container 1 becomes more easily and fast.

The cleaning equipment of the spraying paint gun provided by this invention has the following advantages in comparison with the above-mentioned traditional technologies:

(1) This invention could be applied on the cleaning of the graviton typed praying paint gun as well as the absorb-upward typed spraying paint gun, which is relatively convenient in general usage.

(2) By means of the assembly layout vertically or inclination standing on the pipeline structure of the direct-flowing typed spraying vent or the frozy spraying vent, the inner pipeline of the spraying paint gun with graviton type or absorb upward type as well as the paint can could appear tilt angle on putting and cleaning so that the cleaning solvent and the paint material is easily to flow out to achieve the purpose of full-cleaning.

(3) By means of the assembly layout vertically or inclination standing on the pipeline structure of the direct-flowing typed spraying vent or the frozy spraying vent, the direction of each spraying vent could appear crisscross status which is beneficial to the cleaning of the gun body of the spraying gun and the paint can and it could more efficiently achieve the purpose of cleaning and longer the lifetime of cleaning solvent on actual cleaning.

(4) There could contain the cleaning solvent in the auxiliary cleaning container settled by the branch sum up of this invention; on proceed cleaning the spraying paint gun, it could proceed the pre-wash motion of the spraying paint gun.

(5) The container on cleaning has one characteristic. That is, the cross-sectional geometry shape of the bottom of the container is smaller than that of the top of the container which makes the bottom portion appear cone-shaped so that the cleaning solvent is easily to be gathered and collected and drained out from the drain vent on bottom of the container.

(6) On cleaning the graviton typed spraying paint gun, the paint can of the spraying gun could proceed cleaning motion without disassemble the paint can of the spraying paint can.

(7) The auxiliary cloth-hook set of this invention could be placed on the auxiliary cloth-hook set to dry out after finishing clean up the spraying paint gun.

Many changes and modifications in the above-described embodiment of this invention can, of course, be carried out without departing from the scope thereof. Accordingly, to promote the progress in science and the useful arts, the invention is disclosed and is intended to be limited only by the scope of the appended claims.

What is claimed is:

1. A cleaning equipment of a spraying paint gun, comprising:

a container, a top portion of said container having a vent, said vent having an upper cap cooperatively disposed on said vent, a bottom portion of said container having an injection vent and a drain vent;

a branch sum up supporting the container;

a pipeline structure disposed inside the container, said pipeline structure including a pipeline having an input tube coupled thereto, at least one direct-flowing spraying vent and at least one fixed spraying vent, said input tube being in fluid communication with the injection vent, said at least one direct-flowing spraying vent being vertically directed from the pipeline and the at least one fixed spraying vent being inclined with respect to said pipeline;

an auxiliary rock set which is locked and fixed at positions with respect to the pipeline structure, said auxiliary rock set including at least a stopping rock and a putting rock;

a cloth-hook set connected to the branch sum up;

buckle means interconnecting the pipeline structure with a rigid wiring body.

2. The cleaning equipment of the spraying paint gun as recited in claim 1, wherein said branch sum up supports an auxiliary cleaning container, said auxiliary cleaning container having a gate valve switch on a bottom thereof.

3. The cleaning equipment of the spraying paint gun as recited in claim 1, wherein a cross-sectional contour of said container is smaller than a cross-sectional contour of said upper cap of the container.

4. The cleaning equipment of the spraying paint gun as recited in claim 1, wherein said auxiliary rock set is composed of rigid wiring materials.

5. The cleaning equipment of the spraying paint gun as recited in claim 1, wherein said buckle means is composed of rigid wiring materials.

6. The cleaning equipment of the spraying paint gun as recited in claim 1, wherein said direct-flowing spraying vent has a lockable spraying cap.

7. The cleaning equipment of the spraying paint gun as recited in claim 1, wherein said cloth-hook set includes a cross-bar cloth-hook, a single-cross cloth-hook and a double-cross cloth-hook.

* * * * *